US005472055A

United States Patent [19]

Simson et al.

[11] Patent Number: 5,472,055

[45] Date of Patent: Dec. 5, 1995

[54] LINER HANGER SETTING TOOL

[75] Inventors: James A. Simson, Stafford; John M. Yokley, Kingwood, both of Tex.

[73] Assignee: Smith International, Inc., Houston, Tex.

[21] Appl. No.: 298,001

[22] Filed: Aug. 30, 1994

[51] Int. Cl.[6] ..... E21B 23/00

[52] U.S. Cl. ..... 166/382; 166/208; 166/240

[58] Field of Search ..... 166/382, 208, 166/377, 124, 240

[56] References Cited

U.S. PATENT DOCUMENTS

| | | | |
|---|---|---|---|
| Re. 31,881 | 5/1985 | Lindsey, Jr. | 166/212 |
| 4,603,743 | 8/1986 | Lindsey | 166/208 X |
| 4,671,358 | 6/1987 | Lindsey, Jr. et al. | 166/291 |
| 4,712,614 | 12/1987 | Allwin et al. | 166/208 |
| 4,712,615 | 12/1987 | Dockins et al. | 166/208 |
| 4,898,243 | 2/1990 | Lindsey et al. | 166/290 |
| 5,048,606 | 9/1991 | Allwin | 166/382 X |
| 5,074,362 | 12/1991 | Allwin | 166/382 |
| 5,181,570 | 1/1993 | Allwin et al. | 166/381 |

*Primary Examiner*—Roger J. Schoeppel
*Attorney, Agent, or Firm*—Robert G. Upton

[57] ABSTRACT

A self-contained, telescoping liner hanger setting tool is adapted to set a hanger and attached liner within a wellbore; release the liner hanger by unthreading a running nut securing the tool to the hanger and rotating the liner, after the tool is released from the hanger, during a cementing process, the liner is rotated through a clutch means adjacent the lower end of the tool and the upper end of the hanger, the liner hanger setting tool being fully retrievable from the borehole after the cementing process is ended.

13 Claims, 6 Drawing Sheets

1
2
9
11
11
8
6
5
4
1
7

LINER HANGER SETTING TOOL

BACKGROUND OF THE INVENTION

1. Field of the Invention

This invention relates to liner hangers, methods for hanging a liner casing in a well bore and methods for manipulating a liner casing during a cementing operation.

More specifically, the present invention concerns apparatus and methods to set a liner hanger and the removal of the setting tool with all of the hanger setting mechanisms retained within the retracted setting tool. State of the art liner hanger assemblies leave a portion of the valuable and expensive hanger setting mechanism permanently cemented in the borehole along with the hanger.

2. Background

In well drilling and completion operations, after the borehole is drilled, a tubular liner casing is positioned in the well bore and the annulus between the liner casing and well bore is filled with cement. The liner casing cementing operations are conducted by running the liner casing in the well bore by means of a setting tool and a drill string where the setting tool interconnects the drill string and the liner casing.

U.S. Pat. No. 5,181,570 for example, teaches a liner setting process wherein the liner hanger which is attached to the upper end of the liner casing is set in the well bore at a desired location so that the weight of the liner casing is supported by the liner hanger. Prior to the cementing operation, the setting tool is released from the hanger assembly by shearing shear screws then backing off an internal running nut that secures the setting tool to the hanger. Once the drilling operator is satisfied that the setting tool is in fact released from the hanger and that the entire weight of the casing is suspended from the hanger, the setting tool torque housing is then re-engaged to the hanger. Cement is subsequently introduced through the drill string and through the liner casing and flows out a cement shoe which is attached to the bottom of the liner casing and having a multiplicity of orifices through which cement is introduced into the annulus between the liner casing and the well bore. After filling the annulus with cement, the setting tool is pulled from the liner casing hanger assembly and retrieved with the drill string when the drill string is withdrawn.

To improve the cement bond between the liner casing and the well bore, If the suspended liner casing can be reciprocated and or rotated during the cementing operation. This movement will greatly assist in a uniform distribution of the cement in the annulus and proper displacement of the drilling mud. In order to rotate the liner casing during the cementing process, the drill string must be selectively engaged to the liner casing through the liner hanger so that rotation of the drill string causes the liner casing to be rotated relative to the liner hanger until after the cementing operation is complete. The drill string and setting tool is subsequently disengaged from the liner hanger and is pulled out of the borehole leaving the casing cemented in place.

It goes without saying that the setting operation requires considerable care because once the cementing operation is complete, the liner casing cannot be removed or repositioned. Moreover, if the setting tool fails to disengage prior to the cement hardening, the drill string could also be cemented in place. Such malfunctions can result in the loss of expensive drilling equipment, or worse, the loss of the well.

SUMMARY OF THE INVENTION

It is an object of the present invention to provide a liner hanger setting tool that incorporates all the mechanisms required to set and rotate the liner hanger within the setting tool housing.

It is another object of this invention to permit rotation of the liner hanger while running into the hole thereby providing a means to 'drill down' to clear any obstruction such as ledges, doglegs or keyseats that may be present in the formation in route to the borehole bottom.

It is still another object of the invention to provide a means to rotate a liner hanger and liner string into a highly deviated oilwell to facilitate "running" the liner string in the borehole When a long string of pipe is rotated in highly deviated well, it has a tendency to feed itself over obstructions, curves, dips and other changes in the drilled hole and overcome or minimize the effects of friction due to pipe laying on low side of hole. Whereas, if the string is pushed into a highly deviated hole without rotation, the effects of drag or friction on the pipe increase as the length of pipe is extended into the deviated sections of the borehole. At some point the string cannot be advanced into the borehole unless it is rotated because of limitations of the drill string or the drilling rig.

It is still another object of the invention to permit the use of a 'universal' setting adapter that is simple in its design and relatively short in length. This is true since there is no difficult machining process necessary to the shortened adapter such as internal milled grooves or slots to accommodate manipulatable keys to actuate the hanger and its attached liner since these actuating mechanisms are now contained in the hanger setting tool.

A self contained, telescoping liner hanger setting tool is disclosed. The tool is adapted to set a hanger and attached liner within a borehole casing or wellbore, release the hanger and liner by unthreading a running nut securing the tool to the hanger and rotating the liner after the tool is released from the hanger through a clutch means adjacent the lower end of the tool and the upper end of the hanger.

The liner hanger setting tool consists of a first outer cylindrical housing, the outer cylindrical housing forming first and second ends, a second end of the outer cylindrical housing is releasably secured to the hanger.

A dog housing forms first and second ends, the first end of the dog housing is connected to a drill string. The dog housing is longitudinally slidable concentrically within the first outer cylindrical housing.

A release mandrel is concentrically contained within the dog housing. A first means is retained within the second end of the dog housing to rotate the outer cylindrical housing and liner when the setting tool is either in a first extended position or in a second collapsed position. A second means is retained within the second end of the dog housing to rotate only the release mandrel relative to the outer cylindrical housing when the dog housing is substantially at a mid stroke position within the outer cylindrical housing. The first means to rotate the outer cylindrical housing and liner is disengaged by the translation of the dog housing within the outer cylindrical housing. The second means to rotate the release mandrel is engaged with a kelly. Rotation of the release mandrel relative to the outer cylindrical housing serves to unthread a running nut securing the setting tool to the hanger after the hanger is set.

Clutch means formed at the second end of the outer cylindrical housing remains engaged to the hanger in the "running" position (extended tool), in the "drill down" position (collapsed tool), in the hanger setting position (extended), in the nut release position (mid stroke), and the rotating position (collapsed). The only time the clutch teeth of clutch body are disengaged from the clutch teeth on the setting adapter is after the running nut is released from setting adapter. The entire tool is then lifted from hanger assembly to ensure disengagement of the running nut. The design of the tool is such that the clutch teeth can never be disengaged from the tool until the running nut is released. (The clutch body is trapped between the setting adapter face, running nut and coupling at the end of the kelly effectively locking the clutch teeth rigidly until release of the running nut). The second means retained in the dog housing is then disengaged from the release mandrel enabling the first means to rotate the outer cylindrical housing and the liner to engage the outer cylindrical housing at the collapsed end. The clutch is then re-engaged with the liner hanger for further rotation of the liner. The entire liner hanger setting tool then is subsequently completely removable from the wellbore after the liner is set within the wellbore.

The double dog liner setting tool of the present invention contains three interconnected telescoping components consisting of an outer cylindrical housing, a dog housing and a release mandrel concentrically contained within the dog housing. A first set of spring loaded detent dogs radially extend outwardly from and are equidistantly spaced around the outer wall of the dog housing. When these detent dogs are positioned either at the top or the bottom of the setting tool's stroke, they engage with longitudinally aligned slots milled into the outer cylindrical housing allowing the outer cylindrical housing to rotate the hanger and attached liner assembly. A second set of spring loaded detent dogs extend radially inwardly from the dog housing. When the tool is in a substantially mid stroke position, the second set of detent dogs engage into a longitudinal slot milled into the third release mandrel. In this position, a running nut secured to a setting adapter may be released by the rotating drill string after the liner hanger has been set and prior to the cementing process. A kelly assembly attached to the lower end of the release mandrel and to the setting adapter between the setting tool and the liner hanger consists of a kelly, running nut with keys, a clutch, and a coupling. The kelly assembly's purpose is to transfer the weight of the liner string through the running nut to the drill string and to allow the running nut to be released.

The clutch is formed between the bottom end of the outer cylindrical housing and the upper end of the setting adapter and comprises circumferentially spaced inter-engaging teeth that serve to rotate the liner string while running into the borehole and after the hanger is set and the running nut is released. All rotary motion is transmitted through the clutch to enable the liner string to be rotated during hole cleaning or cementing operations.

The setting adapter is the connection point between the setting tool and the hanger/liner string. It consists of a machined tube with threaded connections for the running nut and tieback receptacle.

The tieback receptacle is threaded unto the upper end of the adapter and serves as a means to allow a packer and seal nipple to run in on top of the set hanger to seal leaks after the cementing process is complete. Moreover, the tieback receptacle also serves to align the clutch assembly after the running nut is released to facilitate rotation of the liner.

An advantage then of the present invention over the prior art is to provide a liner hanger setting tool that allows the liner hanger to be drilled down or rotated when running into a borehole to clear any obstruction that might inhibit progress of the liner casing down the wellbore.

Another advantage of the present invention over the prior art is to provide a liner hanger setting tool that contains all of the mechanisms associated with rotation of the liner hanger with the exception of the mating clutch teeth formed in the upper end of the setting adapter.

Yet another advantage of the present invention over the prior art is to enable the use of an inexpensive, simple and very much shorter setting adapter connecting the setting tool with the liner hanger since all of the liner release mechanisms are contained within the setting tool. The extra length necessary to isolate the running nut releasing position of the setting tool from the rotating position found incorporated in state of the art adapters is now contained within the setting tool assembly.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
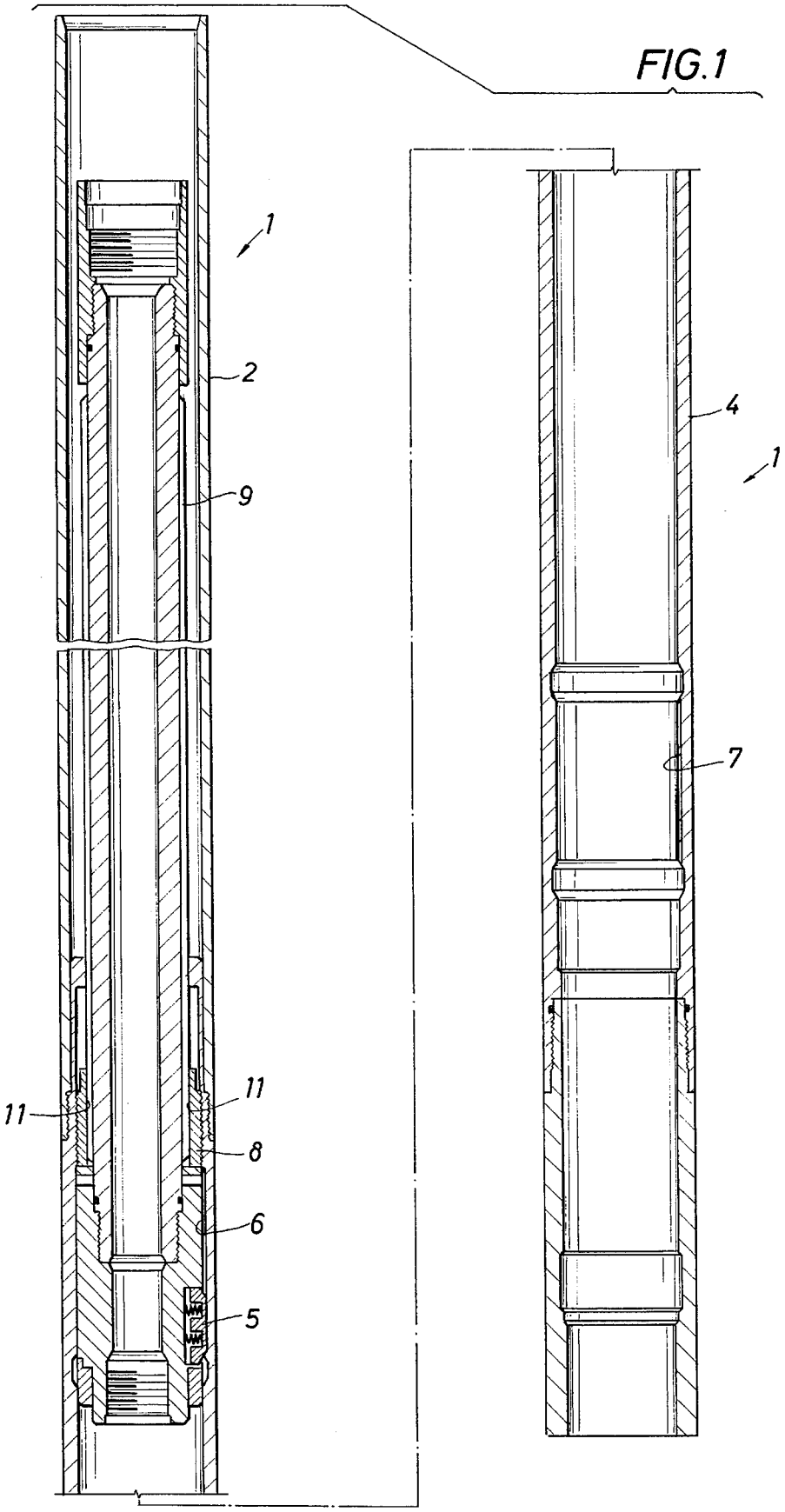
FIG. 1 is a cross-section of a prior art setting tool illustrating an elongated setting adapter with a portion of the liner hanger release mechanism destined to remain in the cemented borehole.

With reference to the prior art of FIG. 1, the liner hanger setting tool generally designated as 1 consists of a mandrel 3 connected through a running nut 8 to an elongated setting adapter 4. Of necessity, the mandrel must reciprocate within the setting adapter in order to set the liner hanger [not shown, see liner hanger 44, FIG. 2] and to back off or release the running nut to enable the setting tool to be removed from a wellbore. A pair of longitudinally oriented shoulders 9 are formed in the exterior surface of the mandrel 3 that register with complimentary slots 11 formed in the interior surface of the running nut 8. A spring loaded detent dog 5 is engaged within a slot 6 formed in an upstream end of the setting adapter. When the dog 5 is within its detent slot 6 and the running nut is threaded unto the setting adapter, the drill string is then secured to the setting adapter. The setting adapter, liner hanger and attached casing [not shown] is then rotatable while the liner is being lowered into the wellbore.

When the proper depth is reached to set the liner hanger, the drill string is raised a few inches to unpin the hanger "J" connection, rotated slightly and lowered to set the hanger in the wellbore casing. The mandrel is then reciprocated downwardly within the adapter moving the dog 5 out of slot 6 midway toward slot 7. The dog 5 is now in a lengthy smooth bore section of the adapter and further rotation of the drill string will unthread the running nut 8 from the end of adapter 4. The mandrel, once it is determined that the running nut is free, is further advanced into the adapter until dog 5 aligns itself with slot 7 formed in the adapter. The liner may again be rotated by the drill string through the slot 7 in the adapter and the dog 5 in the mandrel so that the liner may be rotated during the cementing process.

The adapter 4 is left in the wellbore along with the liner hanger and the liner when the released setting tool is removed from the borehole. The adapter is expensive since it requires extra length to provide sufficient longitudinal space to assure the operator that the running nut is released. The adapter also requires a series of internally milled dog slots [6 and 7] to enable the setting tool to function, all of which is left with the cemented liner thus adding to the expense of the liner cementing operation.

Figure 2:
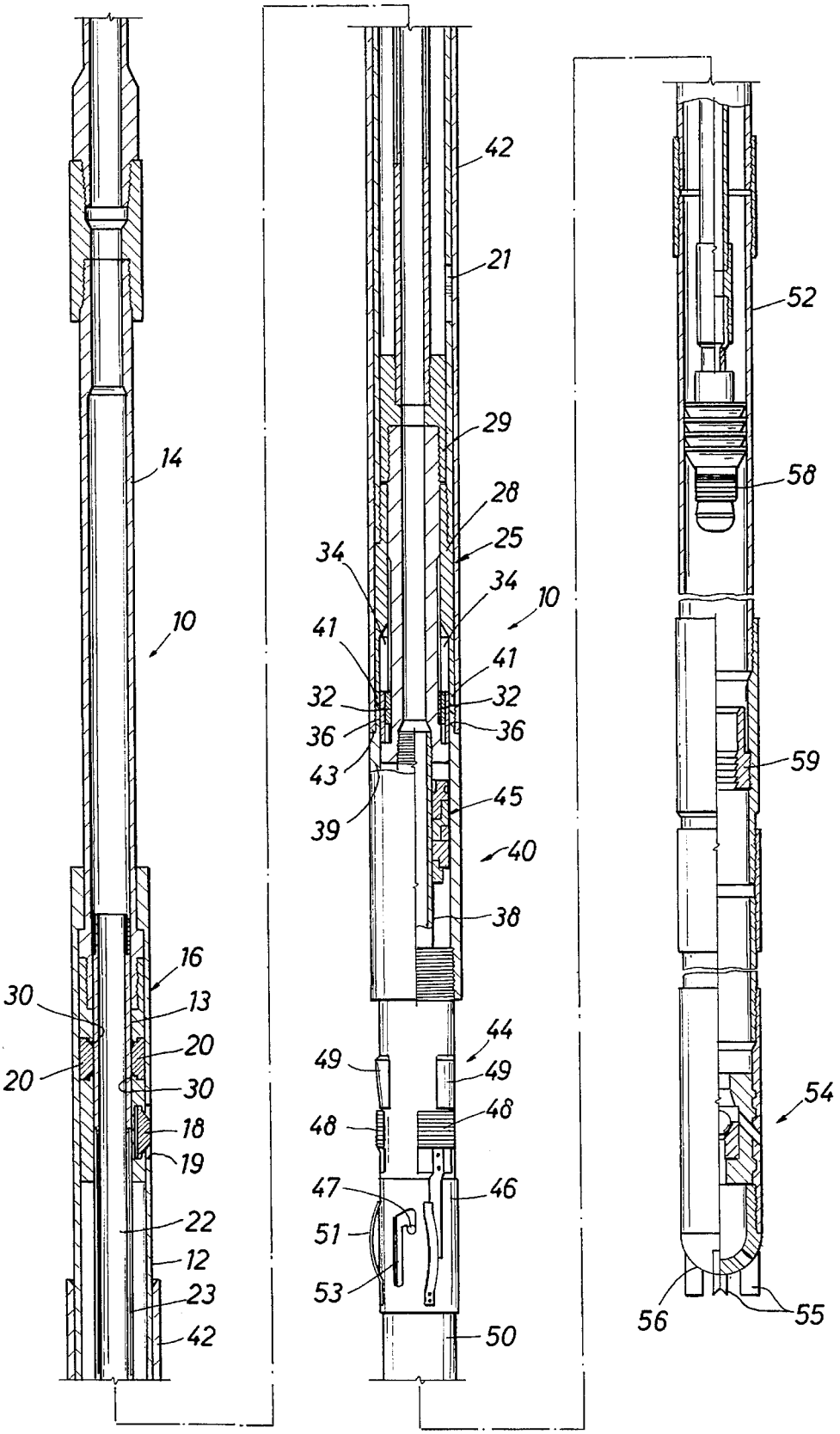
FIG. 2 is a partially broken away cross-section of a liner hanger setting tool assembly of the present invention that is threaded to a drill string; at the base of the tool is affixed a setting adapter, a liner hanger, a liner and a float shoe affixed to the lower end of the liner.

With reference now to the preferred embodiment of FIG. 2, the setting tool generally designated as 10 is a completely self contained system wherein all of the liner setting and liner rotating mechanisms are removable with the tool 10 after the cementing operation. The setting tool 10 consists primarily of a outer cylindrical housing 12, drill string connection pipe 14 with a seal bore 64, detent or "dog" containing housing generally designated as 16 and release mandrel 22, with seal 63 attached to the end 65. The seal 63 and the end 65 of the mandrel 22 that seals the seal bore 64 of the drill string connection pipe 14 allows fluids under pressure to be pumped through the setting tool 10 regardless of the operation of the telescoping action of the drill string 14 and outer cylindrical housing 12 with respect to the mandrel 22. Fluid pressure integrity of the drill string bore 64 is thus maintained. The setting tool is illustrated in the "running in" configuration whereby the tool is at its longest extension, the dog 18 energized by spring 31 housed within assembly 16 is radially outwardly engaged with upper slot 19 formed in housing 12. The dogs 20 also within dog housing 16 are energized by spring 31 and loaded against a smooth cylindrical wall portion 13 of concentric release mandrel 22 and thus are inoperable during the running in operation. The down stream end of mandrel 22 is threadably engaged [27] with the kelly generally designated as 25. The lower end of housing 12 is threadably engaged [29] with the body 28 of the clutch. The clutch body 28 further houses a running nut 32 that, in the liner deployment stage as shown in FIG. 2, is threadably secured to an upper end of a setting adapter generally designated as 40.

The setting adapter 40 connects the tool 10 with the liner hanger assembly 44 and to the tieback receptacle 42. The adapter, unlike the prior art adapter of FIG. 1, is simple in design, much shorter in length and less expensive to manufacture.

A typical liner hanger assembly, generally designated as 44 consists of a body 50 coupled to the adapter 40 at one end and to a liner 52 at its lower end. A cage with a "J" slot 46 surrounds the body 50 and serves to advance the attached slips 48 over the cones 49 once the "J" slot pin 47 is "unjayed" from its normal position relative to the cage 46 thereby "setting" the hanger against the inside of a previously secured casing pipe. Of course, the liner hanger remains in the unset, run in position until the desired borehole depth is reached.

The cylindrical liner 52 is threaded to the base of the liner hanger 44 at an upper end. The lower end contains a float shoe generally designated as 54. The float shoe serves primarily to disperse cement through a multiplicity of ports 56 formed through the shoe. At least a pair of cutter blades 55 are affixed to and protrude from the end of the shoe and serve to remove any obstacles that might be in the borehole while the drill string rotates and advances the setting tool 10 toward the bottom of the borehole. The float shoe also allows a controlled rate of fluid fill of the liner 52 and acts as a check valve or back pressure device to inhibit flow of cement to the interior of the liner 52.

A cylindrical slick joint 38 is threaded into the base of the kelly 25 and extends through the adapter 40, hanger 44 and down into the interior of the finer 52. A retrievable cementing bushing [RCB] generally designated as 45 is retained within the adapter 40. The RCB provides a seal to prevent cement from flowing past the liner top inside diameter during the cementing process. The slick joint allows the setting tool to be stroked after release of the running nut 32 from the adapter 40.

A hollow liner wiper plug 58 is releasably attached to the base of the slick joint 38. A landing collar 59 for the wiper plug is secured within the liner 52 at a predetermined distance below the wiper plug A pump down plug [not shown] releasably secured at the surface within a cementing manifold (not shown) that is connected threadably to the drill string 14, is driven down the interior of the drill string after the cementing operation is complete. The pump down plug is driven into the hollow interior of the wiper plug 58 thereby plugging the passage in the wiper plug. The wiper plug then is released by shearing of shear pins retaining the wiper plug to the end of the slick joint 38 and driving both pump down plug and wiper plug 58 into landing collar 59 displacing cement into annulus of liner 52.

The entire liner setting tool 10 with attached liner 52 is rotated down the borehole in the extended condition as shown in FIG. 2. If no or minor interference is encountered during the run in process, the tool will remain in the extended condition. If however a difficult obstruction is encountered, the tool may be telescoped into outer cylindrical housing 12 retracting dogs 18 from slots 19. Since the annular space 60 between outer housing 12 and release mandrel 22 is filled with a fluid, a provision must be made to transfer fluid to the other end of housing 16 when the tool is telescoping. Axial rectangular slots 61 or machined flats are formed on the outside diameter of the housing 16 (see FIGS. 6 and 7) and ports 62 formed through outer housing 12 provide the means to move fluid to either end of housing 16 and also serve to control the rate of fluid transfer between opposite ends of the dog housing thereby controlling any sudden impacts. Those skilled in the art will also appreciate that the tool could be sealed and filled with a fluid if circumstances were to make this desirable, i.e. contamination, corrosion, etc.

The base 15 of housing 16 now seats against end 24 of the kelly 25 thereby transferring the load through clutch 28. Dog 18 then engages slots 21 formed in housing 12.

During the telescoping action of housing 16 within housing 12 and over mandrel 22, the pressure integrity of drill string is maintained by the seal 63 on mandrel 22 riding inside seal bore 64 in drill string connection pipe 14. In this telescoped position, the drill string may aggressively attack the borehole obstruction with the cutter blades 55 extending from shoe 54.

Figure 3:
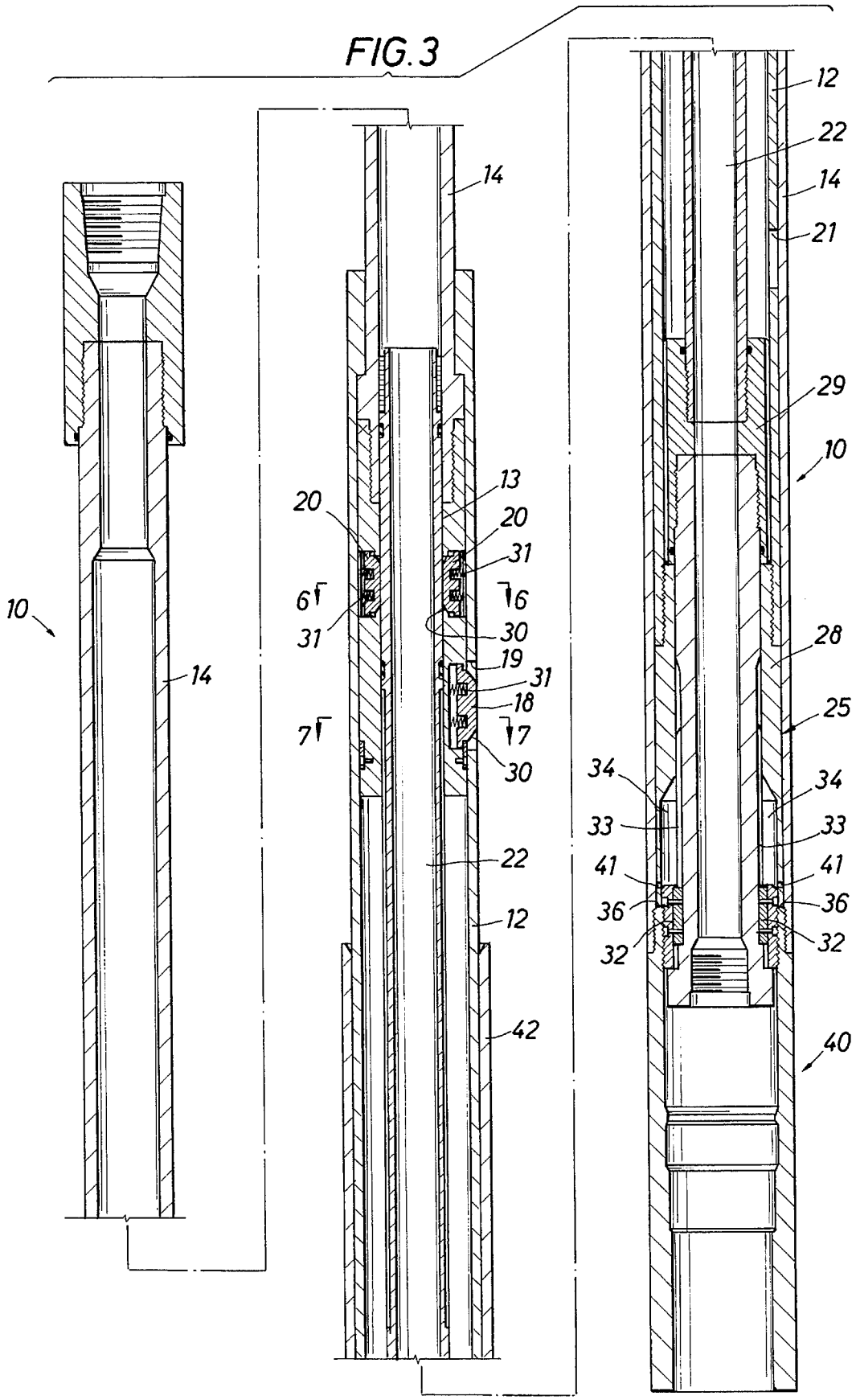
FIG. 3 is a sectioned view of the setting tool in the 'running in' configuration.

Turning now to FIG. 3, the enlarged view of the liner setting tool 10 is shown in the extended position without the hanger or liner attached thereto. The dog 18 is engaged with slot 19 in housing 12 thus assuring that the entire assembly rotates. The tool may be used to rotate while running into the borehole as heretofore mentioned with respect to FIG. 2. The tool may also be used to rotate the liner while circulating fluids and lastly, the tool may be rotated while setting the hanger.

To set the hanger 44 the drill string positions the liner 52 and associated float shoe 54 in the previously set casing such that the float shoe is just off the bottom of the borehole [not shown]. The extended spring arms 51 attached to the cage 46 provide enough friction against the inner casing wall to hold the cage and slips 48 while the drill string is retracted up the wellbore a few inches to unlatch the release pin 47 in the "J" slot 53. The drill string then rotates the setting tool to the right a few degrees and drops down the elongated slot 53 thus driving the hanger slips 48 up the cones 49 thereby forcing the slips 48 outwardly against the previously set casing. The hanger then supports the total weight of the liner hanger.

Figure 4:
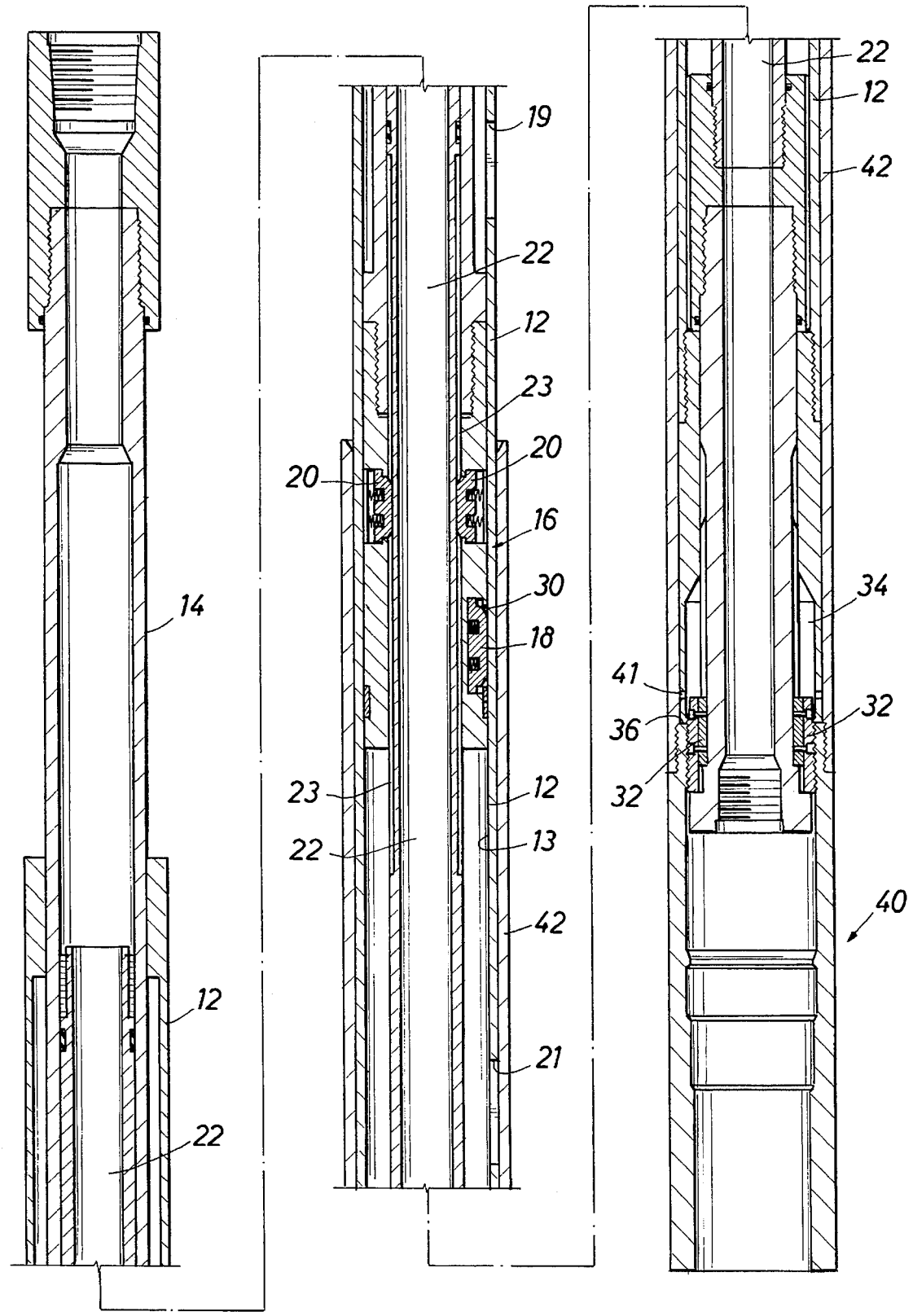
FIG. 4 is a sectioned view of the setting tool in the 'releasing' position.

FIG. 4 illustrates the setting tool 10 in the running nut [32] release position. Once the hanger 44 is set, the running nut may then be released prior to the cementing operation. The drill string connection pipe is telescoped into the housing 12 thereby moving the dogs 18 out of their respective slots 19 into a smooth bore intermediate section 13 in housing 12. Dogs 20 then drop radially inwardly into slots 23 formed in release mandrel 22. Further rotation of the drill string connection pipe rotates the mandrel within the non rotating housing 12 thus unthreading the running nut 32 from the setting adapter 40. The running nut forms an internal axially aligned key that registers with a complimentary groove 33 formed in the kelly 25. The nut 32 is deposited in an annulus 34 formed in the clutch body after it is backed off of the upper end of the adapter 40.

Figure 5:
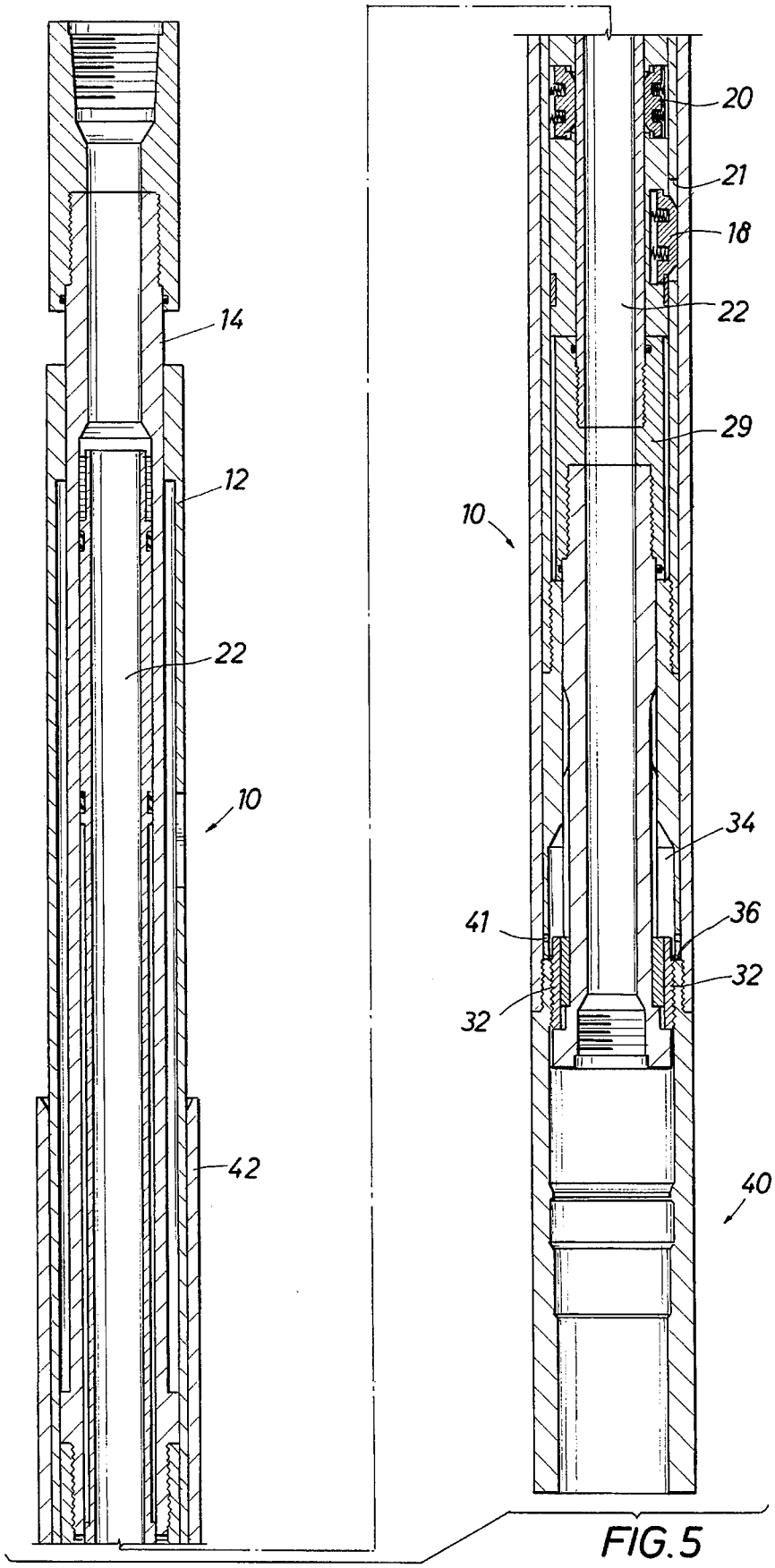
FIG. 5 is a sectioned view of the setting tool in the 'rotation after set hanger' position.

FIG. 5 illustrates the setting tool 10 in a collapsed condition that is best suited to remove wellbore obstructions while running the liner into the borehole as heretofore described. The setting tool is also configured to rotate the liner casing suspended from the "set" hanger assembly 44 after the running nut is released through the clutch mechanism 36. The hanger assembly typically contains bearing means (not shown) designed to support the entire weight of the liner while the drill string rotates the liner during, for example, the cementing operation [not shown].

Figure 6:
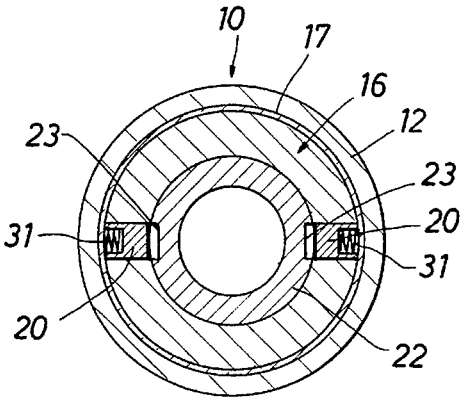
FIG. 6 is a section taken through 6—6 of FIG. 3.

FIG. 6 taken through 6—6 of FIG. 3 illustrates a pair of radially inwardly directed spring loaded dogs 20 that, when aligned, engage axially oriented slot 23 of mandrel 22. A cover plate 17 retains the dogs 20 within housing 16 and a partial cylindrical sleeve (not shown) retains the dog 18 in housing 16.

Figure 7:
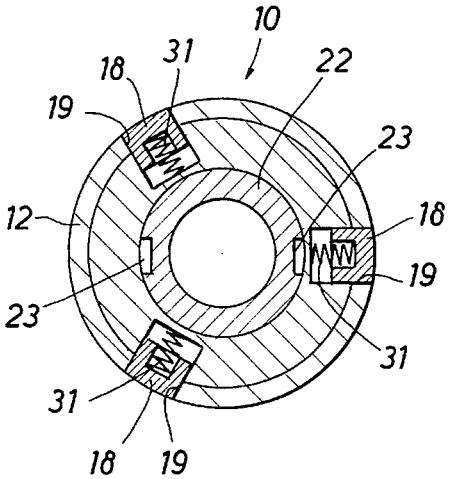
FIG. 7 is a section taken through 7—7 of FIG. 3.

FIG. 7 is a section taken through the three radially outwardly directed spring loaded dogs 18. Each dog 18 is engaged with slots 19 formed in cylindrical housing 12. Dogs 18 align with and engage slots 21 in housing 12 when the drill string connection pipe telescopes within housing 12, end 15 of connection pipe abutting end 25 of kelly and clutch 28 as heretofore described. In addition, the outer surface formed by dogs 18 and 20 are tapered [30] so that, as the connection pipe telescopes in and out of the housing 12 the dogs are cammed into and out of their respective slots 19, 21 and 23 [see FIG. 2]. Fluid transfer slots 61 serve to move fluids from one end to the other end of housing 16 as heretofore described.

Figure 8:
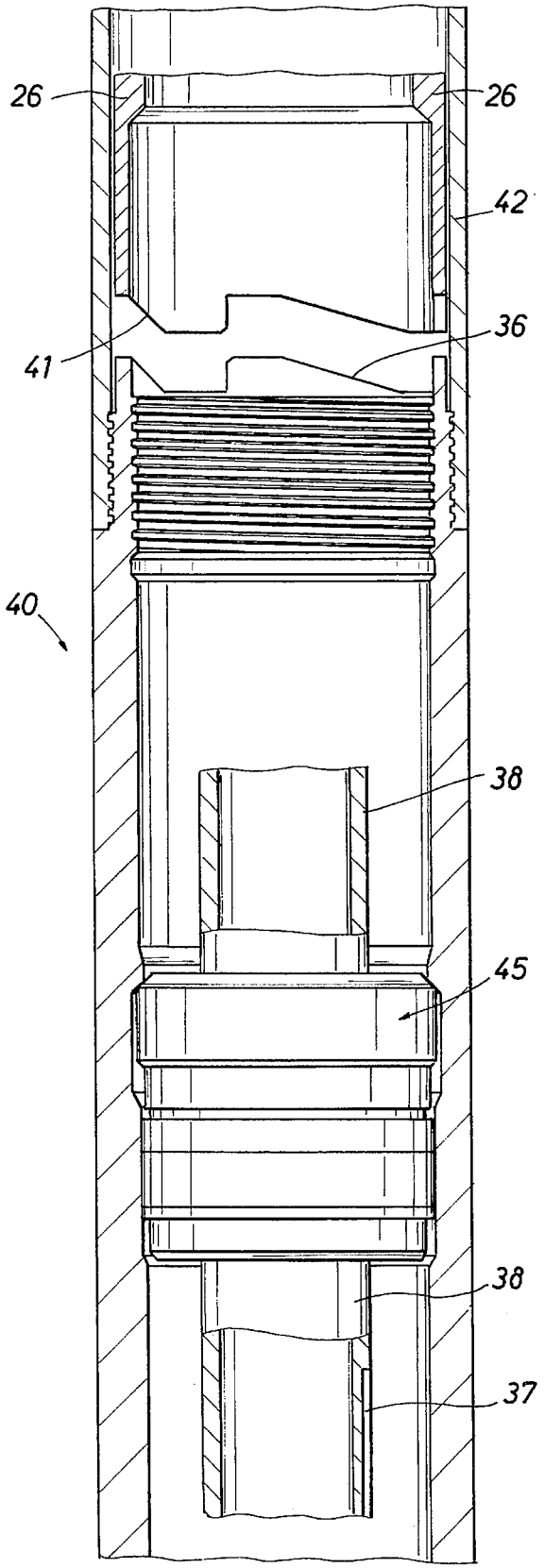
FIG. 8 is an enlarged sectioned view of the setting adapter illustrating the clutch mechanism at an upstream end of the adapter.

FIG. 8 is an enlarged cross section of the setting adapter 40 forming the clutch engaging mechanism 41 at the running nut connection end of the setting adapter. Complimentary clutch engaging teeth formed on the downstream end of the clutch body 28 serves to drive the liner casing 52 rotationally during the cementing operation when the clutch is engaged. Therefore, a means to rotate the liner is always assured before and after releasing nut provided dogs 18 are engaged with slots 19 or 21 and clutch teeth 36 and 41 are engaged.

It will of course be realized that various modifications can be made in the design and operation of the present invention without departing from the spirit thereof. Thus while the principal preferred construction and mode of operation of the invention have been explained in what is now considered to represent its best embodiments which have been illustrated and described, it should be understood that within the scope of the appended claims the invention may be practiced otherwise than as specifically illustrated and described.

What is claimed is:

1. A self contained, telescoping liner hanger setting tool is adapted to set a hanger and attached liner within a wellbore; release said hanger and liner by unthreading a running nut securing said tool to said hanger and rotating said liner after said tool is released from said hanger through a clutch means adjacent the lower end of the tool and the upper end of the hanger, said liner setting tool comprising:

a outer cylindrical housing, said outer cylindrical housing forming first and second ends, said second end of said outer cylindrical housing is releasably secured to said hanger, a dog housing forming first and second ends, said first end of said dog housing is connected to a drill string, said dog housing is longitudinally slidable concentrically within said outer cylindrical housing, a release mandrel concentrically contained within the dog housing, a first means retained within said second end of the dog housing to rotate said outer cylindrical housing and liner when said setting tool is either in a first extended position or in a second collapsed position, a second means retained within said second end of the dog housing to rotate only the release mandrel relative to said outer cylindrical housing when said dog housing is substantially at a mid stroke position within said outer cylindrical housing, said first means to rotate said outer cylindrical housing and liner being disengaged by the translation of the dog housing within said outer cylindrical housing, said second means to rotate the release mandrel is engaged with a kelly, the rotation of the release mandrel relative to the outer cylindrical housing serves to unthread a running nut securing the setting tool to the hanger after said hanger is set, clutch means formed at the second end of the outer cylindrical housing remains engaged to the hanger at all times except when said running nut is released from the hanger, the entire setting tool may then be lifted from the hanger to ensure disengagement of the running nut, the hanger after the setting tool is in its fully collapsed position and said running nut is unthreaded from the hanger, said second means retained in the dog housing is disengaged from said release mandrel enabling the first means to rotate said outer cylindrical housing and said liner to engage said outer cylindrical housing at said second end, the clutch means is then re-engaged with the liner hanger for subsequent rotation of the liner, the entire liner hanger setting tool is completely removable from said wellbore after said liner is set within the wellbore.

2. The invention as set forth in claim 1 wherein said first means retained within said dog housing to rotate said outer cylindrical housing and liner consists of at least one energized detent dog that extends radially outwardly from said dog housing, the at least one detent dog being alignable either with at least one detent slot formed at one end or at an opposite end of said outer cylindrical housing depending on whether said tool is in an extended position or in a collapsed position.

3. The invention as set forth in claim 2 wherein said outwardly extending detent dog is energized with a spring.

4. The invention as set forth in claim 1 wherein said second means retained within said dog housing to rotate only the release mandrel relative to said outer cylindrical housing is at least one detent dog extending radially inwardly from said dog housing, the at least one inwardly extending detent dog engages at least one slot formed in an outer wall of said release mandrel when said dog housing is in a substantially mid stroke position into said outer cylindrical housing a sufficient distance to align said inwardly extending detent dog with said slot in said release mandrel.

5. The invention as set forth in claim 4 wherein said inwardly extending detent dog is energized with a spring.

6. The invention as set forth in claim 1 further comprising means to transfer fluid from said second end of said dog housing to said first end of said dog housing when said dog housing is telescoped within said first outer cylindrical housing.

7. The invention as set forth in claim 6 wherein said means to transfer said fluid is at least one axially aligned opening formed between said dog housing and said outer cylindrical housing, said opening extending substantially from said first end of said dog housing to said second end of said dog housing.

8. The invention as set forth in claim 7 wherein said at least one axially aligned opening is a slot formed in an outer cylindrical surface formed by said dog housing.

9. The invention as set forth in claim 8 wherein said dog housing forms three axially aligned slots substantially 120° apart in said outer cylindrical surface formed by said dog housing.

10. The invention as set forth in claim 1 further comprising a seal means positioned at an upper end of said release mandrel, said seal means forms a seal between an inner bore of the drill string and said release mandrel to allow drilling fluid to be pumped through the setting tool regardless of the position of the setting tool.

11. A self-contained, telescoping liner hanger setting tool, said setting tool being adapted to set a hanger with a liner attached thereto within a wellbore, release said liner by unthreading a running nut securing said tool to said hanger and rotating said liner after said tool is released form said hanger through a clutch means, the entire setting tool being retrievable after said liner is secured within a wellbore, said liner hanger setting tool comprising:

a outer cylindrical housing, said outer cylindrical housing forming first and second ends, said second end of said outer cylindrical housing is releasably secured to said liner hanger, a dog housing forming first and second ends, a first end of said dog housing is connected to a drill string, said second end of said dog housing containing a first means to rotate said outer cylindrical housing and a second means to rotate an inner release mandrel, said dog housing being longitudinally slidable concentrically within said outer cylindrical housing, said first means to rotate said outer cylindrical housing and liner consisting of at least one energized detent dog extending radially outwardly from said dog housing, the at least one detent dog being alignable either with a first detent slot formed at said first end of said outer cylindrical housing or a second detent slot formed at said second end of said first outer cylindrical housing, a second means to release said running nut securing said liner to said hanger setting tool after said hanger is set within said wellbore consisting of at least one energized detent dog extending radially inwardly from said dog housing, said at least one detent dog extending radially inwardly engages a slot formed in an outer wall of said release mandrel when said dog housing is telescoped within said outer cylindrical housing to a substantially mid stroke position to align said inwardly directed detent dog with said slot in said release mandrel, said first means to rotate said outer cylindrical housing disengages from said first slot in said first end of said outer cylindrical housing when said dog housing moves longitudinally into said outer cylindrical housing to align said second means to release said running nut with said slot in said release mandrel, the radially outwardly extending detent dog rides against a smooth bore inner wall section of said outer cylindrical housing insuring that only the release mandrel rotates relative to the outer cylindrical housing, said running nut is released and retained within an annulus formed in said clutch adjacent a setting adapter, said dog housing is subsequently telescoped all the way into said outer cylindrical housing aligning said first means to rotate said outer cylindrical housing and liner with said second detent slot formed in said second end of said outer cylindrical housing, said radially outwardly directed detent dog engages said second slot and said radially inwardly directed detent dog moves out of said slot formed in said release mandrel, said inwardly directed detent dog riding on an outer smooth wall portion when said outwardly directed detent dog is engaged with said second slot in said outer cylindrical housing, and a clutch means formed at said second end of said outer cylindrical housing engages a complimentary clutch means formed by a first end of said liner hanger enables said liner hanger setting tool to rotate said liner after the running nut securing the tool to the hanger is released, the entire liner hanger setting tool then is subsequently completely removable from said wellbore after said liner is set within said wellbore.

12. A method to manipulate a telescoping liner hanger setting tool including a means to rotate said tool and liner while running said tool and liner into a wellbore, a means to rotate said tool and liner while either in an extended or a collapsed state, a means to back off a running nut to release the setting tool from the hanger, a means to rotate said liner after the setting tool is separated from said hanger and, a means to remove the entire setting tool after the liner is set in the borehole comprising the steps of;

connecting a first end of a collapsible dog housing to a drill string, said dog housing being concentrically contained within a outer cylindrical housing, a second end of the dog housing forming a first means to rotate said outer cylindrical housing and a second means to independently rotate a release mandrel with respect to said outer cylindrical housing, said release mandrel is contained within said dog housing, engaging said first means to rotate said outer cylindrical housing and liner to a first end of said outer cylindrical housing when said dog housing is extended out from said outer cylindrical housing, engaging said release mandrel by said second means to rotate said release mandrel formed at said second end of said dog housing when said dog housing is moved inwardly to an intermediate position within said outer cylindrical housing, said first means to rotate said outer cylindrical housing is disengaged when said dog housing moves into said outer cylindrical housing, unthreading said running nut connecting said outer cylindrical housing with said hanger by rotating said release mandrel independently of said outer cylindrical housing, further collapsing said dog housing completely within said outer cylindrical housing after said running nut is released, said second means to independently rotate said release mandrel is disengaged from said release mandrel when said dog housing is fully collapsed, engaging said first means at said second end of said dog housing to rotate said liner with a second end of said outer cylindrical housing, rotating said liner through a clutch means formed between said second end of said outer cylindrical housing and a first end of said hanger after said running nut is unthreaded, and removing the entire liner hanger setting tool after said liner is set within said wellbore.

13. The method as set forth in claim 12 further comprising the step of transferring fluid to and from a first end of said collapsible dog housing to a second end of said collapsible dog housing when said dog housing telescopes into and out of said cylindrical housing.

* * * * *